United States Patent [19]

Feigenblatt, Jr. et al.

[11] Patent Number: 4,591,836

[45] Date of Patent: May 27, 1986

[54] BATTERY OPERATED PANIC ALARM WRIST WATCH

[76] Inventors: Nathan Feigenblatt, Jr.; George Spector, both of 233 Broadway, RM 3615, New York, N.Y. 10007

[21] Appl. No.: 692,343

[22] Filed: Jan. 16, 1985

[51] Int. Cl.[4] ..... G08B 13/00

[52] U.S. Cl. ..... 340/574; 200/61.58 R; 340/539

[58] Field of Search ..... 340/574, 568, 687, 571, 340/539; 128/DIG. 15, 903; 200/DIG. 2, 61.58 R

[56] References Cited

U.S. PATENT DOCUMENTS

| | | | |
|---|---|---|---|
| 3,478,344 | 11/1969 | Schwitzgebel et al. | 340/539 X |
| 3,938,126 | 2/1976 | Ransom | 340/571 |
| 3,988,724 | 10/1976 | Anderson | 340/539 |
| 4,063,410 | 12/1977 | Welling | 128/903 X |
| 4,158,197 | 6/1979 | Takagaki | 340/574 |
| 4,227,189 | 10/1980 | Davis | 340/574 X |
| 4,300,129 | 11/1981 | Cataldo | 340/574 X |
| 4,394,644 | 7/1983 | DiLeo et al. | 340/571 |
| 4,520,351 | 5/1985 | Altman et al. | 340/574 |

FOREIGN PATENT DOCUMENTS

| | | | |
|---|---|---|---|
| 2050117 | 12/1980 | United Kingdom | 340/574 |

*Primary Examiner*—Glen R. Swann, III
*Assistant Examiner*—Thomas J. Mullen, Jr.

[57] ABSTRACT

A wrist watch alarm having a watch and a band, and audio transducer for producing an audio signal and being disposed in the watch, a battery for powering the audio transducer and being disposed in the band, a magnetic switch for activating the battery and being disposed in the band, and VELCRO® for keeping the band closed. The magnetic switch is closed when the VELCRO® does not close the band.

5 Claims, 5 Drawing Figures

BATTERY OPERATED PANIC ALARM WRIST WATCH

BACKGROUND OF THE INVENTION

The present invention relates to a battery operated panic alarm wrist watch. More particularly, it relates to panic alarm devices that are worn by the user.

Panic alarm devices of the above-mentioned general type are known in the art. For example, U.S. Pat. No. 4,157,540 to Oros teaches a wireless alarm system that is mounted on a belt worn by the user and activated by pressure. Another example, U.S. Pat. No. 4,227,189 to Davis teaches an alarm system mounted in a belt buckle and needing a remotely mounted battery pack. A final example, U.S. Pat. No. 4,300,129 to Cataldo teaches a signal system mounted in a belt buckle and activated by distending the waist.

The many rapes, muggings and general need for emergency aid cries out for an alarm that is always ready for instant use. Wrist watches are presently universally accepted and worn by the public during both day and night. The hook and loop watch band makes for easy "yank-off" operation, even during the highest emotional fears displayed by the victim. The hook and loop watch band can be pulled loose by the victim or knocked loose during the struggle.

SUMMARY OF THE INVENTION

Accordingly, it is the primary object of the present invention to provide a battery operated panic alarm wrist watch which avoids the disadvantages of the prior art.

Another object of the present invention is to provide a battery operated panic alarm wrist watch which produces an audio signal when it is released from the wrist, such as during a struggle.

Yet another object of the present invention is to provide a battery operated panic alarm wrist watch that is held together on the wrist by VELCRO ®.

Still another object of the present invention is to provide a battery operated panic alarm wrist watch which will operate in a shower, while sleeping or driving, and while conducting business or playing sports.

DETAILED DESCRIPTION OF THE PREFERRED EMBODIMENT

Figure 1:
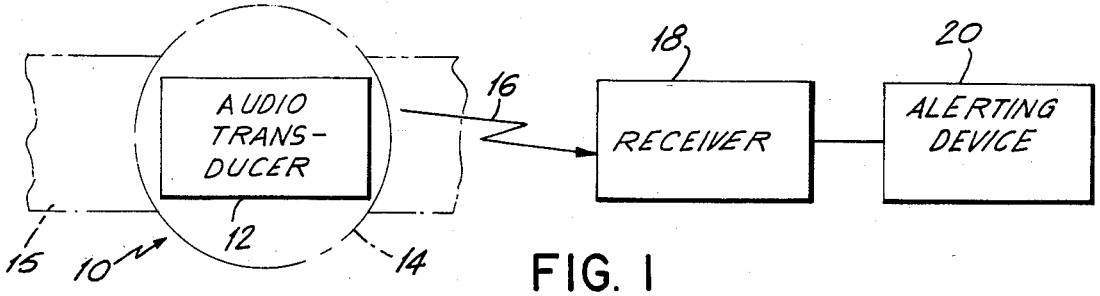
FIG. 1 is a block diagram of the invention.

Referring now to FIG. 1, the battery operated panic alarm wrist watch is shown generally at 10 and includes an audio transducer 12 in a case 14 and a watchband 15. The audio transducer 12 may be mounted on or in the case 14. The audio transducer 12 sends a signal 16 to a receiver 18 and an alerting device 20. The receiver 18 and the alerting device 20 may be disposed either externally of the case 14 on the watchband 15 or externally of the watchband 15 in a remote location.

Figure 2:
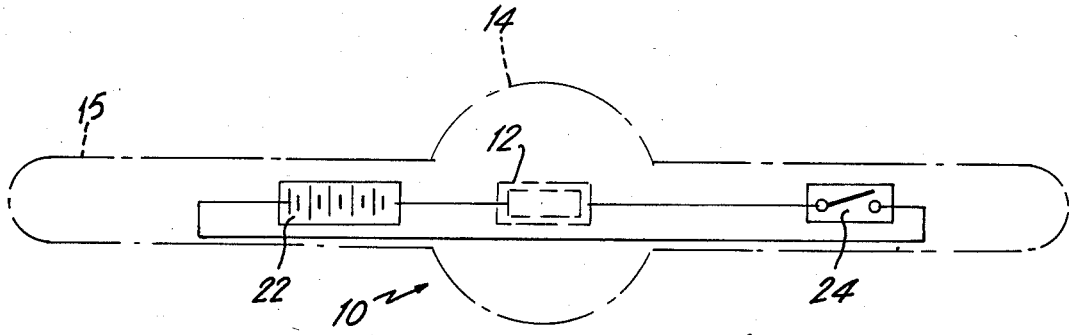
FIG. 2 is schematic view of the wireless transmitter assembly incorporated into the watch.

In FIG. 2 is shown the basic location of the pertinent parts of the battery operated panic alarm wrist watch 10. Both a battery 22 and a switch 24 are mounted on the rear face of the watchband 15 while the audio transducer is disposed in the case 14. For ease of placement of parts, the battery 22 and the switch 24 are mounted on the watchband 15 on either side of the case 14. The battery 22 is connected to the audio transducer 12 which is connected to the switch 24 which is then connected back to the battery 22.

Figure 3:
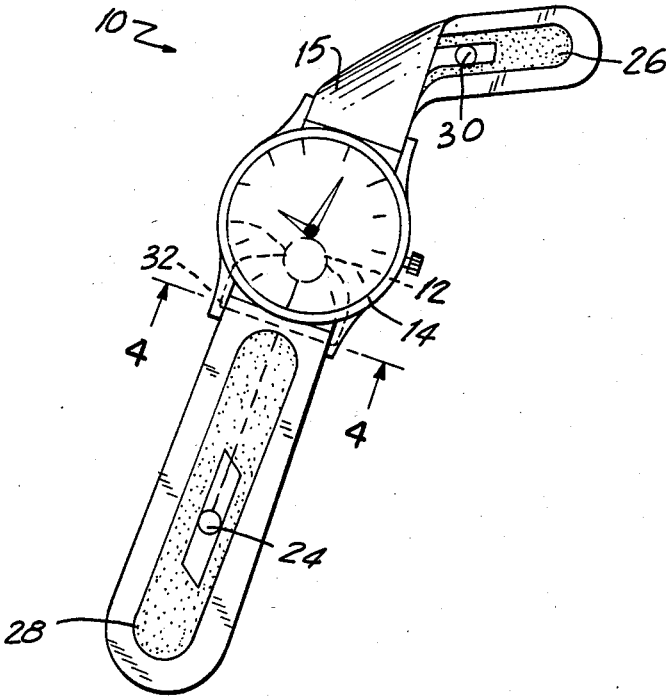
FIG. 3 is a perspective view of the watch showing the structures on the band.

The details of the front of the battery operated panic alarm wrist watch 10 and the actual placement of the switch 24 is shown in FIG. 3. A strip of VELCRO ® 26 lines the rear side of one half of the watchband 15, while another strip of VELCRO ® 28 lines the front side of the other half of the watchband 15. The magnetic switch 24 is embedded in the VELCRO ® 28, while a switch contact button 30 is embedded in the VELCRO ® 26. The magnetic switch 24 is in the normally on position when the watchband 15 is unfastened. A pin spring strap holder 32 assists in connecting the circuit elements.

Figure 4:
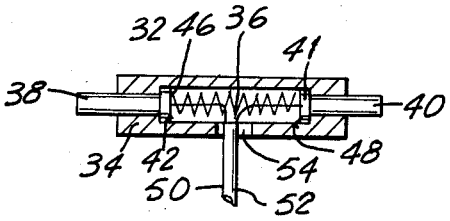
FIG. 4 is an enlarged cross sectional view taken along line 4—4 in FIG. 3 showing detail of the pin spring strap holder.

The details of the pin spring strap holder 32 is shown in FIG. 4. The pin spring strap holder 32 consists of a hollow cylinder 34 containing a spring 36. The spring 36 is held in place in the hollow cylinder 34 by two pins 38 and 40. The pins 38 and 40, each have a flanged head 42 and 44, respectively, that meet shoulders 46 and 48, respectively, of the hollow cylinder 34 and thereby provide a stop for the biasing action of the spring 36. Wires 50 and 52, coming from the watchband 15 enter the hollow cylinder 34 through a throughbore 54 and attach to the pins 38 and 40, respectively. Therefore, when the pin spring strap holder 32 connects the watchband 15 to the case 14, the circuit is connected. Additionally, due to the spring 36, the pin spring strap holder 32 is removable and thereby permitting changing of the watchband 15.

Figure 5:
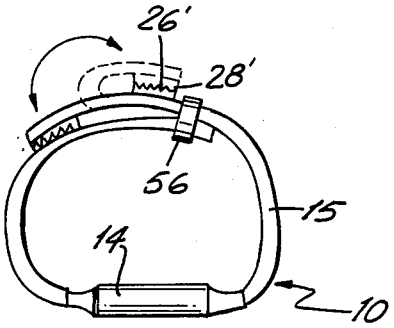
FIG. 5 is a side view of a modification in a secured position whereby the end portion of the band pulls up to activate the switch.

A modified attachment, VELCRO ® 26' and 28' and a buckle 56 is shown in FIG. 5. In this embodiment the end of the watch band 15 pulls up while a buckle 56 holds the watch 10' on the user.

In operation, the watch 10 is placed on the wrist and held closed by the VELCRO ® 26, 28. In the closed position, the switch contact button 26 presses on the magnetic switch 24 and keeps the switch open. When the VELCRO ® 26, 28 is separated (such as during a struggle) the magnetic switch 24 will close and the audio transducer 12 will activate.

We claim:

1. A wrist watch alarm, comprising:

(a) a watch having a band;

(b) means for producing an audio signal and being disposed in said watch;

(c) means for powering said audio signal producing means and being disposed in said band;

(d) means for applying said powering means and being disposed in said band; and (e) means for keeping said band closed on the user and being disposed on said band so that when said band closing means is opened, said power applying means permits said audio signal producing means to produce an audio signal and when said band closing means is closed said power applying means prevents said audio signal producing means from producing an audio signal.

2. A watch as defined in claim 1, wherein said audio signal producing means include an audio transducer.

3. A watch as defined in claim 2, wherein said powering means include a battery.

4. A watch as defined in claim 3, wherein said power applying means include a magnetic switch.

5. A watch as defined in claim 4, wherein said band closing means include VELCRO ®; and further comprising means for connecting said magnetic switch to said audio transducer, said connecting means include a pin spring strap holder having a hollow cylindrically shaped body containing a spring and two pins movably mounted and extending from each end of said hollow body, said pins having a flange mating with a shoulder disposed internally of said hollow body so that said spring biases said pins against said shoulders, wires entering said hollow body and being connected to said pins so that the circuit between said strap and said watch is connected.

* * * * *